US005826654A

United States Patent [19]

Adnan et al.

[11] Patent Number: 5,826,654

[45] Date of Patent: Oct. 27, 1998

[54] MEASURING RECORDING AND RETRIEVING DATA ON COILED TUBING SYSTEM

[75] Inventors: Sarmad Adnan, Alvin; Roger W. McBride, Sugar Land, both of Tex.

[73] Assignee: Schlumberger Technology Corp., Houston, Tex.

[21] Appl. No.: 787,320

[22] Filed: Jan. 24, 1997

Related U.S. Application Data

[60] Provisional application No. 60/011,149 Jan. 6, 1996.

[51] Int. Cl.[6] ..... E21B 47/00

[52] U.S. Cl. ..... 166/250.01; 166/77.2; 73/152.52; 364/551.01; 364/558; 364/567; 364/570

[58] Field of Search ..... 166/75.11, 77.1–77.3, 166/250.01; 73/152.51, 152.52; 364/550, 551.01, 558, 567, 570

[56] References Cited

U.S. PATENT DOCUMENTS 4,091,867 5/1978 Shannon et al. ..... 166/77.3
4,940,095 7/1990 Newman .
5,351,533 10/1994 MacAdam et al. ..... 166/77.2 X

OTHER PUBLICATIONS

David Bigio, Andy Rike, Axel Christensen, Jim Collins, Doug Hardman, Denis Doremus, Patrick Tracy, Glen Glass, Niels Bo Joergensen, Douglas Stephens; *Coiled Tubing Takes Center Stage;* Oct. 1994; pp. 9–23.

*Primary Examiner*—Roger J. Schoeppel
*Attorney, Agent, or Firm*—Bush, Riddle & Jackson

[57] ABSTRACT

A system and method for sensing and determining operating features of coiled tubing (14) that is run in and out of a borehole. The coiled tubing (14) is stored on a reel (10) mounted on a reel frame (13) for transport from one job site to another. A reel database (22) is secured to the reel frame (13) at the first job site for the coiled tubing (14) and remains on the reel frame (13) for transport with the coiled tubing (14) for the entire life of the coiled tubing (14). The system provides for updating of the reel database (22) from sensor interface modules (SIMS 30B–30G) for predetermined operating characteristics of the coiled tubing (14) during operations. The system provides that data from the reel database (22) may be retrieved at a new job site to provide an accurate and current history of the predetermined characteristics of the coiled tubing (14).

15 Claims, 6 Drawing Sheets

MEASURING RECORDING AND RETRIEVING DATA ON COILED TUBING SYSTEM

REFERENCE TO RELATED PROVISIONAL APPLICATION

This application claims the benefit of U.S. Provisional Application No. 60/011,149 filed Jan. 26, 1996.

FIELD OF THE INVENTION

This invention relates generally to the art of drilling oil and gas wells and in particular to a system and method for sensing, measuring and recording data concerning characteristics of coiled tubing, and still more particularly to an apparatus and method for storing and retrieving such data at each well site concerning predetermined features or characteristics of the coiled tubing.

BACKGROUND OF THE INVENTION

Coiled tubing deployed from a reel is widely used today for many downhole applications such as drilling slimhole wells less than five (5) inches in diameter and for production logging. Other applications for coiled tubing include a well workover operation without utilizing a rig, and delivering treatment fluids to subterranean formations particularly in horizontal wells.

Coiled tubing is formed of flexible steel and is run in and out of a bore hole. The tubing is stored on a reel and is normally fed from the reel over a gooseneck of an injector for directing the tubing downwardly for insertion within a bore hole. After use of the tubing downhole, the tubing is withdrawn from the well and rewound on the reel. The reel has a reel support frame normally mounted on a skid. The skid with the reel and wound tubing thereon may be transported from one site to another. One of the characteristics of the coiled tubing on which accurate data is required involves fatigue of the coiled tubing. Coiled tubing is fatigued when it is run in and out of the hole particularly from bending and stressing of the tubing as it is run over the gooseneck. Fatigue is dependent also on other various factors such as the speed of the injection and withdrawal of the tubing, the weight supported by the tubing, the length of the tubing within the well, the fluid pressure within the well and within the tubing, and the internal and external diameters of the tubing. Parameters have been established for selected features or characteristics of the coiled tubing. The life expectancy of the tubing may be estimated from such parameters. When certain selected parameters are exceeded for a coiled tubing, it should be replaced.

If accurate data concerning a particular coiled tubing is not obtained at each job site and recorded for retrieval at another job site, the parameters for replacement of such coiled tubing may be exceeded without knowledge of the operator. Heretofore, the operator at each job site was responsible for obtaining and recording pertinent data in a database for the coiled tubing. The updating of the database for each coiled tubing reel is mandatory by certain operators and/or regulatory authorities and has generally been performed either manually or by a suitable tape recorder, for example.

Two of the major fatigue factors for coiled tubing are the weight and length of the coiled tubing. Monitoring at a job site, including the recording equipment for the coiled tubing, involves substantial costs and is time consuming. Also, the recording and storage process is subject to human error and may at times be neglected. Thus, upon transfer of coiled tubing from one job site to another job site, inaccurate data concerning features or characteristics of the coiled tubing at the new job site may be retrieved from a paper or computerized database of the coiled tubing that must be physically transmitted to the new job site separate from the coiled tubing or its reel or skid. As a result inaccurate or incomplete data such as data involving the life expectancy of the coil tubing may be retrieved at a new job site.

It is desired that an accurate and complete database for predetermined features of each coiled tubing reel be provided which is updated after the completion of each job and is permanently attached to each reel for travel with the reel and retrieved at a new job site.

SUMMARY OF INVENTION

The present invention concerns the collection and storage of data for a coiled tubing reel which is automatically stored permanently in a small memory unit which is permanently and physically associated with the reel so that the data for the coiled tubing of the reel may be easily retrieved at a new job site by a computer at the new site. The reel database is installed on the reel frame which is normally mounted on a skid prior to the initial installation of the reel at the time that it is first used. As a result of its permanent mounting on the reel frame, the reel database of a memory unit thereafter travels with the coiled tubing reel throughout the life of the coiled tubing and is updated during each operation and is the database for all data or information concerning a specific coiled tubing reel. A computer at a job site receives information from a plurality of sensors and processes such information for transmission to the reel database where the information is stored for retrieval. Utilizing appropriate software, a computer associated with a well job site processes information received from the various sensors and may utilize predetermined parameters. Then the processed information is transmitted to the reel database without any significant input from the operator at the job site. A backtup copy of the reel database is maintained by the computer or by a suitable laptop and is available in the event that the reel database or module is damaged or accidentally detached from the reel.

Each sensor comprises an interface module that has a microcontroller utilizing a single chip. The chip also has the capability of converting analog sensor signals to digital signals. The sensor module for the reel which is utilized for the reel database is similar to the sensor modules for sensing other predetermined factors or characteristics of the coiled tubing except for the inclusion of additional memory for the reel database.

The job monitoring and recording equipment used heretofore was cumbersome to set up and to operate. The present system provides a simplified job set up and operation to permit an inexperienced computer operator to record a job by simply turning on the computer system at the beginning of a job and turning it off after the completion of the job. The system acquires and records the job data and stores it in computer memory. If a floppy disk is present in the drive, the system copies the job data to the floppy disk before powering down. Each sensor includes a sensor module connected to it by means of a short length of cable. Sensor parameters may be stored in each module to include information such as sensor name, type, range, input type, calibration information, serial number, usage log and other pertinent information. Field personnel store the information for each sensor module upon initial installation of the system. This information is written in the module memory and updated by the computer as needed.

The sensors are connected together by a single cable originating at the job site main central computer and looped about and between the equipment and terminated back at the main central computer. The loop comprises four shielded wires to distribute data to and from each sensor on one pair of wires and to power the sensor on another pair of wires. Power is supplied from both ends of the network so that an open circuit anywhere in the loop may be tolerated. Monitoring of the network power identifies that a failure may have occurred and also aids in locating a place of an open in the cable. Each sensor has a single chip. A microcontroller in the chip can interface to convert analog sensor signals to digital sensor signals for instrumentation of a measurement system on a per sensor basis. Most sensors typically report once each second.

Job recording systems for coiled tubing have commonly been directed to certain predetermined factors or characteristics of the coiled tubing such as, for example the circulating pressure, the depth or length of tubing, the weight of the tubing, any ovality in the tubing cross section, and the type of fluid being conveyed or transported through the coiled tubing. Different job sites may sense and record different characteristics or factors of the coiled tubing depending on the various conditions encountered at a particular site. Sensors that are used within the wellhead may comprise various load cells, encoders, or pressure transducers to produce analog signals from a sensor module.

The present system is particularly useful in providing accurate and complete information of predetermined characteristics of coiled tubing on a coiled tubing reel which is transported from one job site to another job site by permanently mounting a reel database assembly on the coiled tubing reel upon use of the coiled tubing at its first job site. The information or data on the reel database is updated at each job site and is easily retrieved at a job site by a computer. Such information may be used to determine the life expectancy of the coiled tubing and may result in possible replacement of the coiled tubing. The information is particularly useful in the collection and storage of data relating to fatigue factors or characteristics of the coiled tubing.

An object of this invention is to provide a system for receiving, measuring, and recording data concerning characteristics of coiled tubing including a method and apparatus for storing and retrieving such data at each job site on a database assembly that is permanently and physically attached to a reel frame on which the coiled tubing is wound.

A further object of the present invention is to provide a database permanently secured to a coiled tubing reel and including a memory unit for storing and updating retrievable information concerning predetermined factors or characteristics of the coiled tubing.

DESCRIPTION OF THE INVENTION

Figure 1:
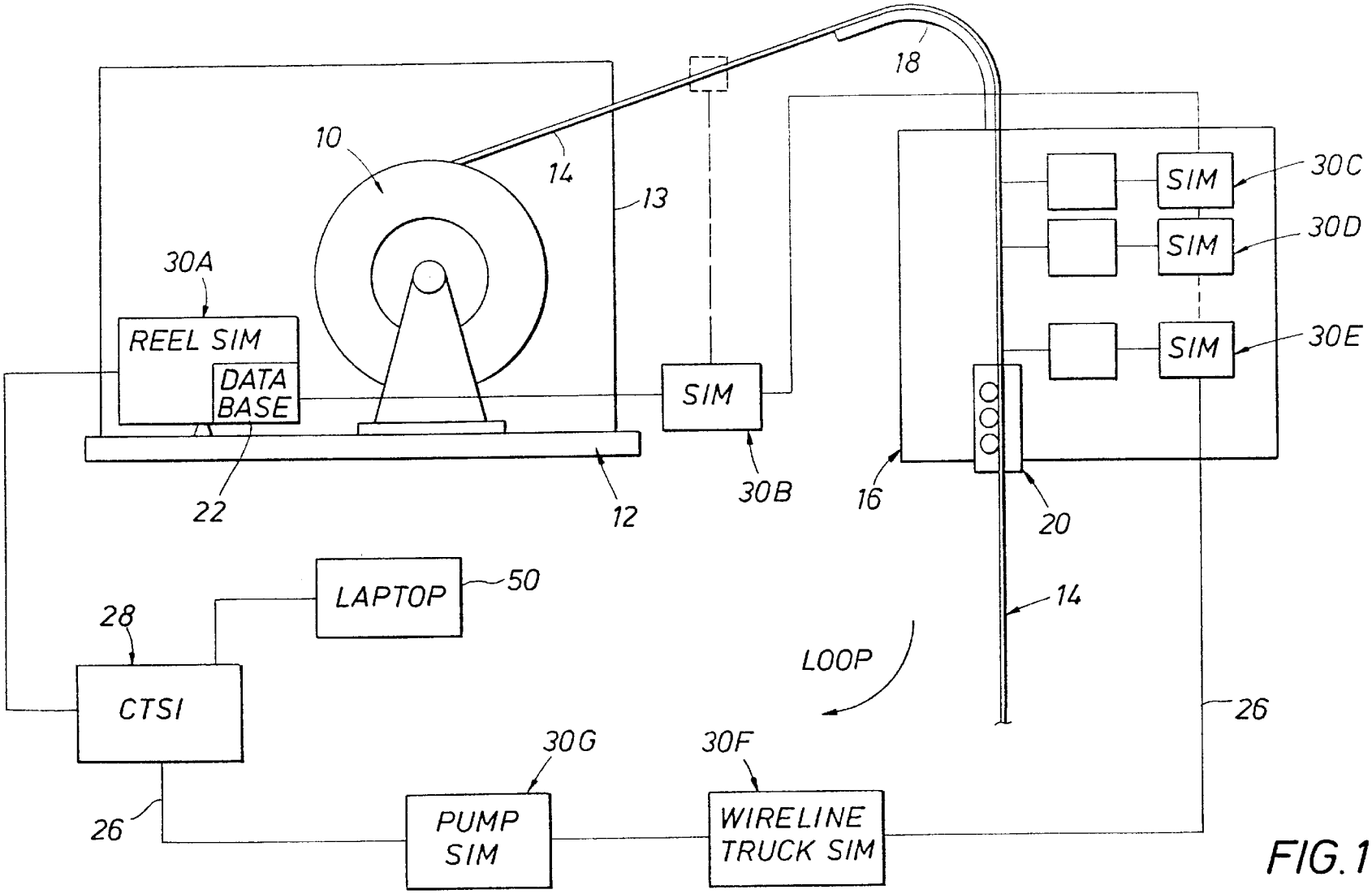
FIG. 1 is a diagrammatic view of the system comprising the present invention for measuring, recording and storing data which are characteristic of coiled tubing.

FIG. 1 illustrates diagrammatically the system of the present invention for sensing, recording, and storing data concerning characteristics of coiled tubing so that the data may be easily retrieved at another job site. A coiled tubing reel is shown at 10 mounted on a skid 12 for transport from one job site to another job site. A reel frame 13 on skid 12 mounts reel 10 for rotation. Coiled tubing shown at 14 is wound onto reel 10 and is unreeled for being injected downhole. Coiled tubing 14 is used for many downhole applications particularly in the drilling of slim holes less than five (5) inches in diameter.

A wellhead injection device as shown generally at 16 has a gooseneck 18 for diverting the coiled tubing 14 vertically downwardly. Wellhead injection device 16 includes a drive mechanism for forcing tubing 14 downwardly. A lower wellhead structure 20 receives tubing 14 and normally includes a blowout preventor (BOP) stack. For further details of the structure for unreeling and injecting coiled tubing in a borehole, reference is made to U.S. Pat. Nos. 4,091,867 dated May 30, 1978 and 4,940,095 dated Jul. 10, 1990. The entire disclosure of U.S. Pat. No. 4,091,867 is incorporated by reference for all purposes.

Skid 12 with reel frame 13 and reel 10 thereon may be transported from one job site to another job site often thousands of miles apart. It is desirable that an accurate history of the characteristics of the coiled tubing be available and easily retrieved at a new job site for review, particularly in regard to the possible life of the coiled tubing so that a proper consideration can be given to replacement of the coiled tubing 10. For this reason, a reel database 22 is permanently mounted on frame 13 for coiled tubing 10 prior to its use at the first job site. The reel database 22 is permanently fixed with and travels with reel 10 for the entire life of coiled tubing 10. Database 22 includes a memory unit where information concerning coiled tubing 12 is stored for retrieval at each job site. The present invention is particularly directed to a system for providing accurate information to database 22 for storage without any significant input from the operator at the job site.

Figure 3:
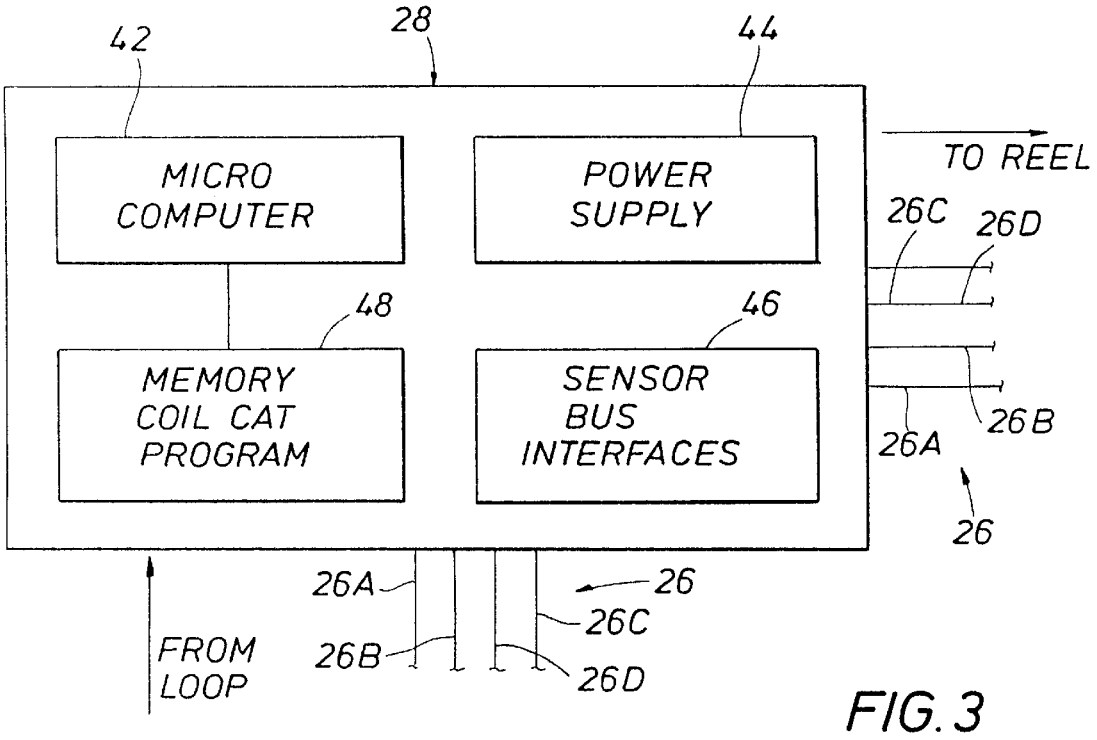
FIG. 3 is a diagrammatic view of the coiled tubing sensor interface (CTSI) forming the main microprocessing unit and receiving information from the sensor interface module (SIM) or modules for processing.

For this purpose and referring generally to FIG. 1, a continuous cable loop generally indicated at 26 originates at a Coiled Tubing Sensor Interface (CTSI) 28 which forms the main data processing unit at a job site and is looped about and between the equipment or various elements of the system for termination back at CTSI 28. Looped cable 26 comprises four shielded wires 26A, 26B, 26C, and 26D as shown in FIG. 3. Wires 26A and 26B provide power; wires 26C and 26D distribute data to and from various Sensor Interface Modules (SIMS) 30A, 30B, 30C, 30D, 30E, 30F and 30G located along the continuous cable loop 26 the Coiled Tubing Sensor Interface (CTSI) 28 permits an automatic update and maintenance of reel database 22. A Sensor Interface Module (SIM) is normally provided for monitoring each of the selected characteristics or features of the coiled tubing. The SIMs are capable of receiving and/or sending data concerning the selected characteristics or features. A SIM 30A for reel 10 includes database 22. The location and number of the sensor interface modules (SIMS) might vary from one job site to another job site.

Figure 2:
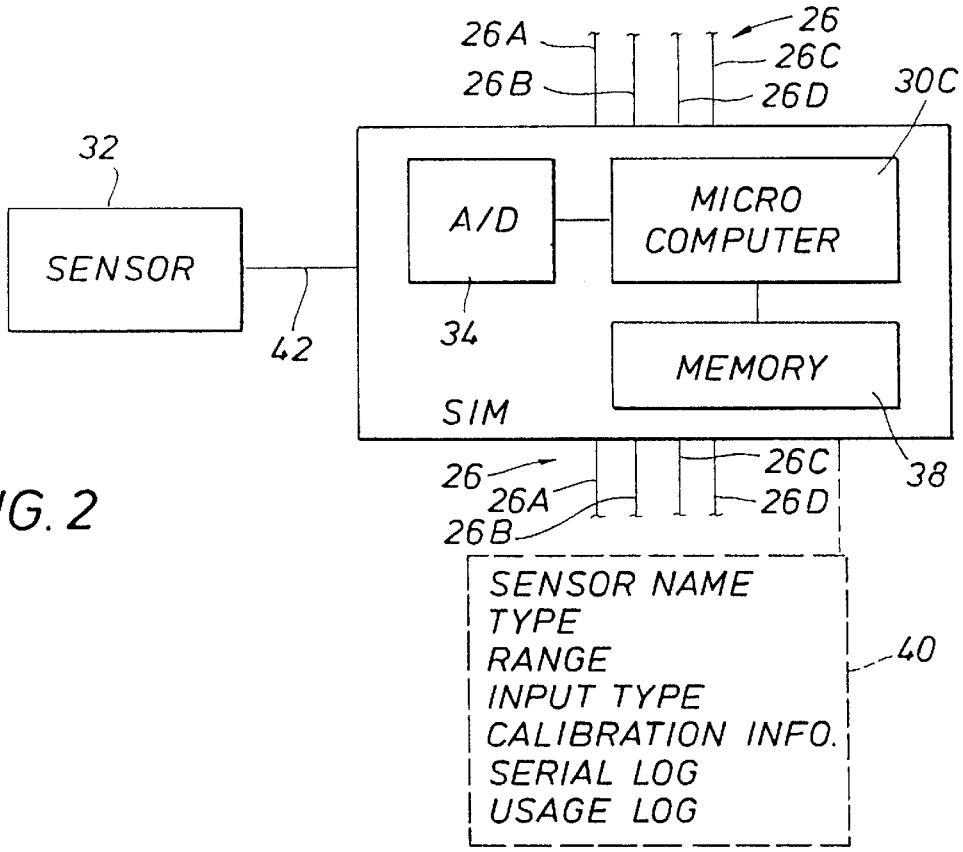
FIG. 2 is a diagrammatic view of a typical sensor interface module (SIM) provided for each selected characteristics of the coiled tubing to be sensed and positioned in the system set forth in FIG. 1.

A typical SIM is illustrated diagrammatically by SIM 30C in FIG. 2 which has a sensor 32 coupled thereto. Sensor 32 may comprise a strain gage, a load cell, a pressure transducer, or other type of parameter sensing device depending on the particular characteristic of the coiled tubing desired to being monitored. An analog/digital converter is shown at 34; a microprocessor is shown at 36 with a memory unit shown at 38. Each SIM 30A–30G has parameters stored therein as shown at 40 which includes sensor name, type, range, input, type, calibration information, serial number, usage log and other predetermined parameters as may be desired. Field personnel store the desired information in each SIM once when the SIM is first installed. The information is written in the SIM memory and updated by CTSI 28 as needed. Since all SIMS 30A–30G are connected by cable 26 which begins and ends at CTSI 28, power is applied from each end of cable 26 so that an open circuit in the cable 26 does not cause malfunctioning of the system. Each SIM 30A–30G comprises a small box with an encapsulated electronic circuit board and a small terminal strip. The board contains a microprocessor 36. Normally a small pigtail cable 42 connects sensor 32 to SIM 30C as shown in FIG. 2. A chip that has been found to be satisfactory is Motorola 68HC05x32.

The characteristics of coiled tubing 14 which are being sensed by SIMS 30B–30G are as follows:

| SIM | SENSED COILED TUBING CHARACTERISTIC |
|---|---|
| 30B | Ovality of coiled tubing, outer diameter of coiled tubing |
| 30C | Weight of coiled tubing in well |
| 30D | Length of coiled tubing in well |
| 30E | Wellhead Fluid Pressure |
| 30F | Wireline Truck (provides and receives data) |
| 30G | Pump truck-annulus fluid pressure and circulating fluid pressure. |

The above sensed characteristics of coiled tubing 14 are merely examples of the various characteristics which might be sensed or monitored. Other characteristics may include the density of fluid in the well, type of fluid in the well, pump rates and pressures, downhole temperatures, BOP valve positions, injector motor pressure, sensor voltage, speed of coiled tubing injection, pressure for injecting coiled tubing and so on. SIM 30A for reel 10 is similar to the remaining SIMS 30B–30G but includes a larger memory unit for storing data as database 22.

It may be desirable to access reel database 22 when CTSI 28 is not available or may not be powered. For this reason, a communication disconnect may be provided for SIM 30A; a desktop or laptop PC may then be connected to SIM 30A for downloading reel database 22 onto a memory unit of the PC or to floppy disc memory of the PC disc. Alternatively, a communication circuit as part of CTSI 28 may be provided that permits connection of a desktop or laptop PC to SIM 30A by PC connection to CTSI 28 rather than directly to SIM 30A.

Barriers are positioned externally of the SIMS to isolate individual sensors from the wellhead zone. With the use of a barrier for each SIM, four (4) to twenty (20) milliampere sensors, such as load cells, encoders, or pressure transducers may communicate analog signals to its associated SIM.

CTSI 28 is shown diagrammatically in FIG. 3 including a microcomputer 42, a power supply 44, sensor bus interfaces 46, and a memory 48 which includes a COILCAT program. To supply power to sensors 32 on a sensor bus provided by cable 14, a power supply of between twelve (12) volts and twenty four (24) volts is used for power supply 44. Power to the CPU chassis and any expansion boards is supplied by a separate CPU power supply (12V to 5V). Power from both of the supplies is routed through a power monitoring board (a SIM module laid out on the board) and connected to the sensor bus. This allows all relevant parameters of the power supply to be monitored. This functionality is necessary to implement the redundant loop type wiring of the sensor bus provided by cable 14. Power is provided to cable 14 at both ends. One cable end is utilized for transmitting and receiving while the other end is utilized for monitoring. If the hardware detects large differences in the current (possibility indicating a break or a short in the cable) it reroutes both power and sensor bus signals to the other end of the loop.

A laptop computer shown at 50 (see FIG. 1) for the COILCAT software program is connected to CPSI 28 for interfacing of software between laptop computer 50 and CPSI 28. The COILCAT software program must be compatible with the software of CPSI 28. The COILCAT software at the end of each job, after an indication from the operator, recalculates data for the reel database 22 based on the data obtained by SIMS 30B–30G and stores such recalculated data in database 22 of the reel SIM 30A. This occurs without significant input from the operator at the job site. A backup copy of reel database 22 is also received and stored at CPSI 28 or laptop computer 50 as may be predetermined. As indicated, reel SIM 30A is similar to the remaining SIMS 30B–30G except that SIM 30A has additional nonvolatile memory for reel database 22. Reel database 22 is an integral part of SIM 30A. SIM 30A is secured to and travels with reel 10 and reel frame 13 from job site to job site.

Figure 4A:
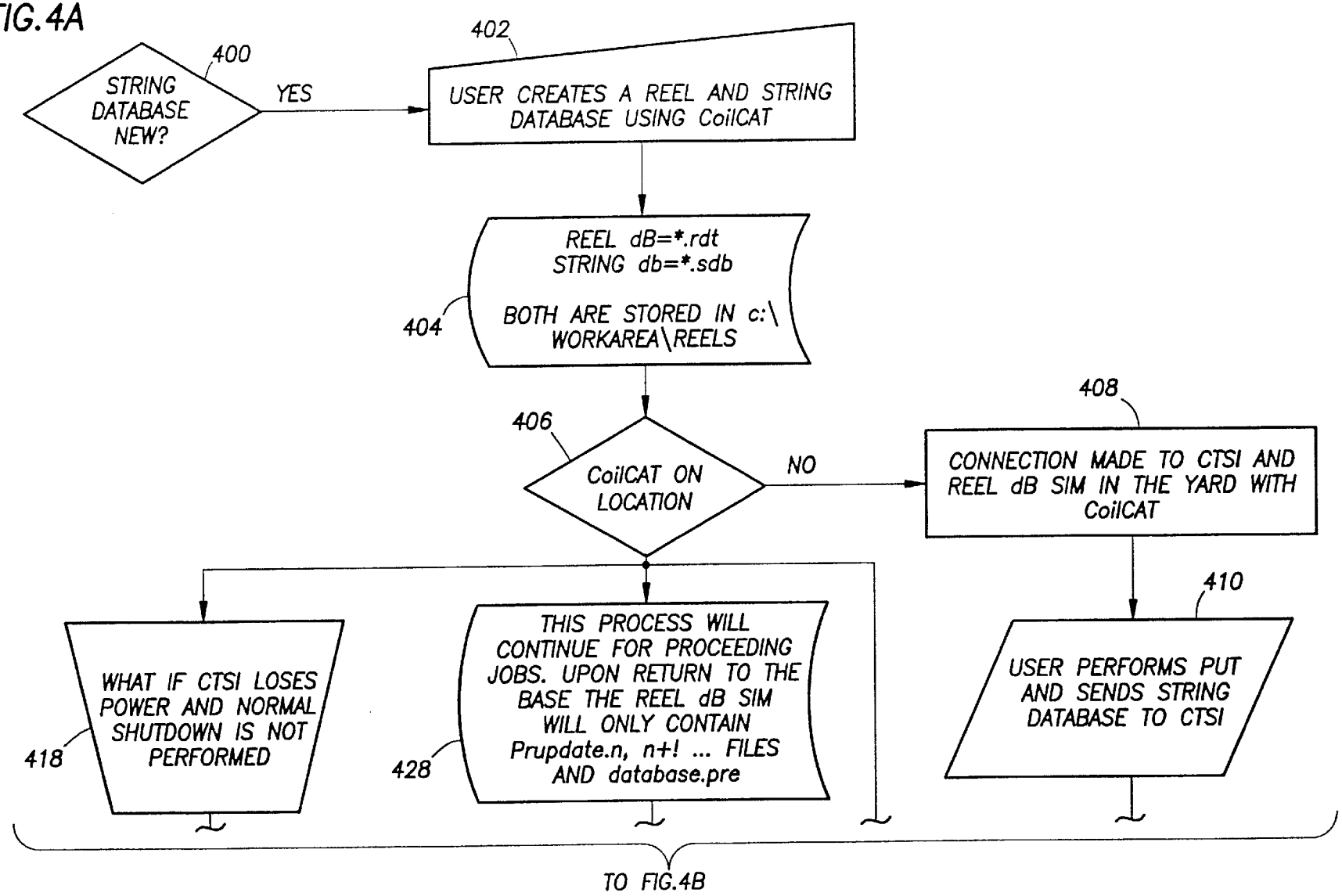
FIGS. 4A and 4B represent a flow chart of a software program for storage of data concerning characteristics of coiled tubing when the coiled tubing operation is shutdown and the database for the coiled tubing reel is not being used.
Figure 4B:
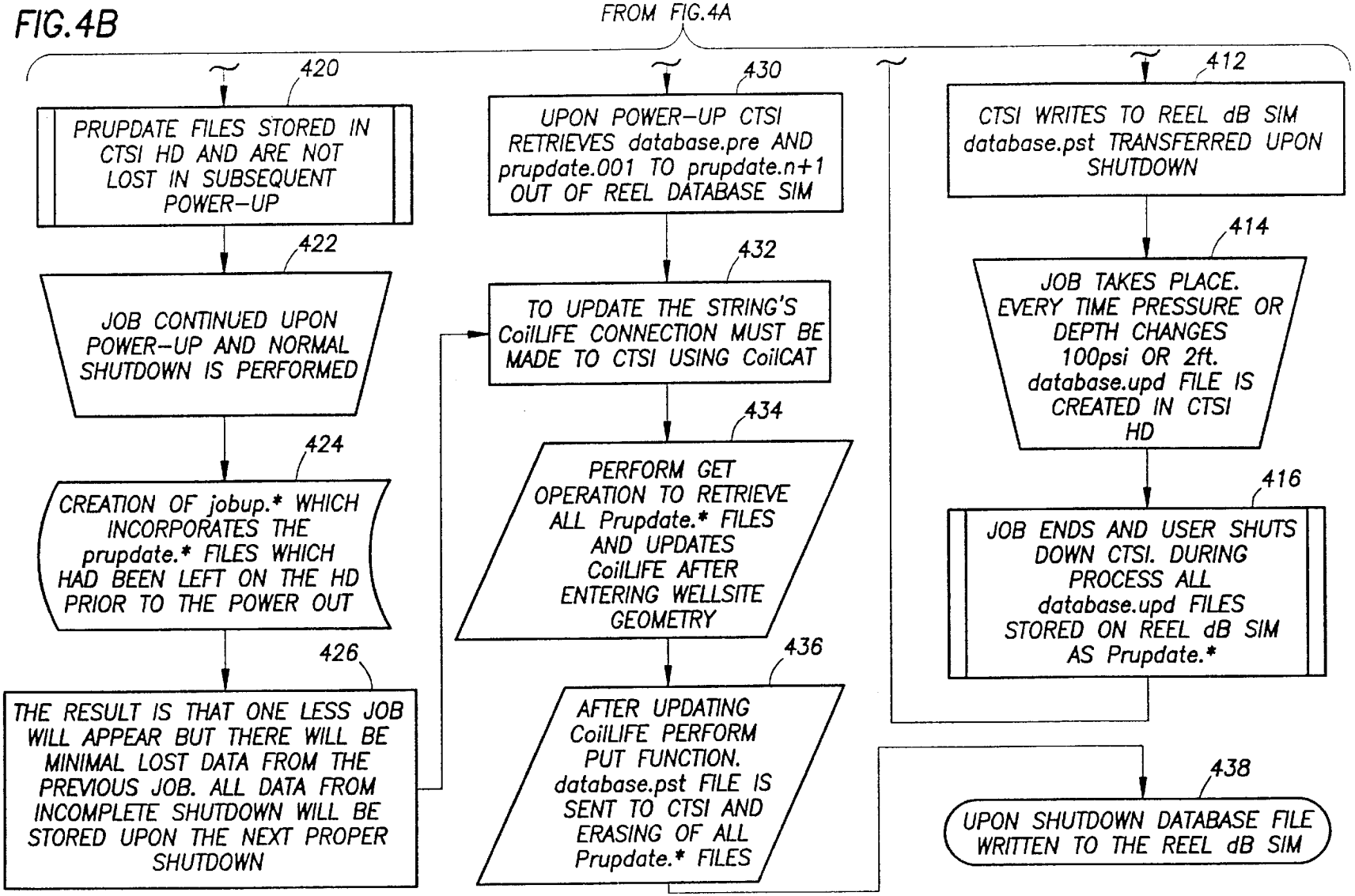

FIGS. 4A and 4B illustrate a software program for the storage of a job database file within reel database 22 and CPST 28 when laptop computer 50 and COILCAT software are not being used on the job site. Logic blocks 400–406 describe preliminary functions accomplished by software within CTSI 28 and reel database SIM 30A. If a COILCAT software program is not resident at an operation site computer, logic blocks 408–416 are performed. If a COILCAT software program is resident at an operating location, the functions described by logic blocks 418–426 are performed if the CTSI loses power and normal shutdown is not performed. If power is present or normal shutdown is performed, logic blocks 428 and 430 are performed. Logic blocks 432–438 describe functions for updating data files and transmitting same to the reel database of SIM 30A.

The computer program listing labeled c:\HC05\CAN\SIM\FLASH.ASM comprises the computer program resident in a SIM microprocessor such as reel SIM 30A of FIG. 1.

Figure 5A:
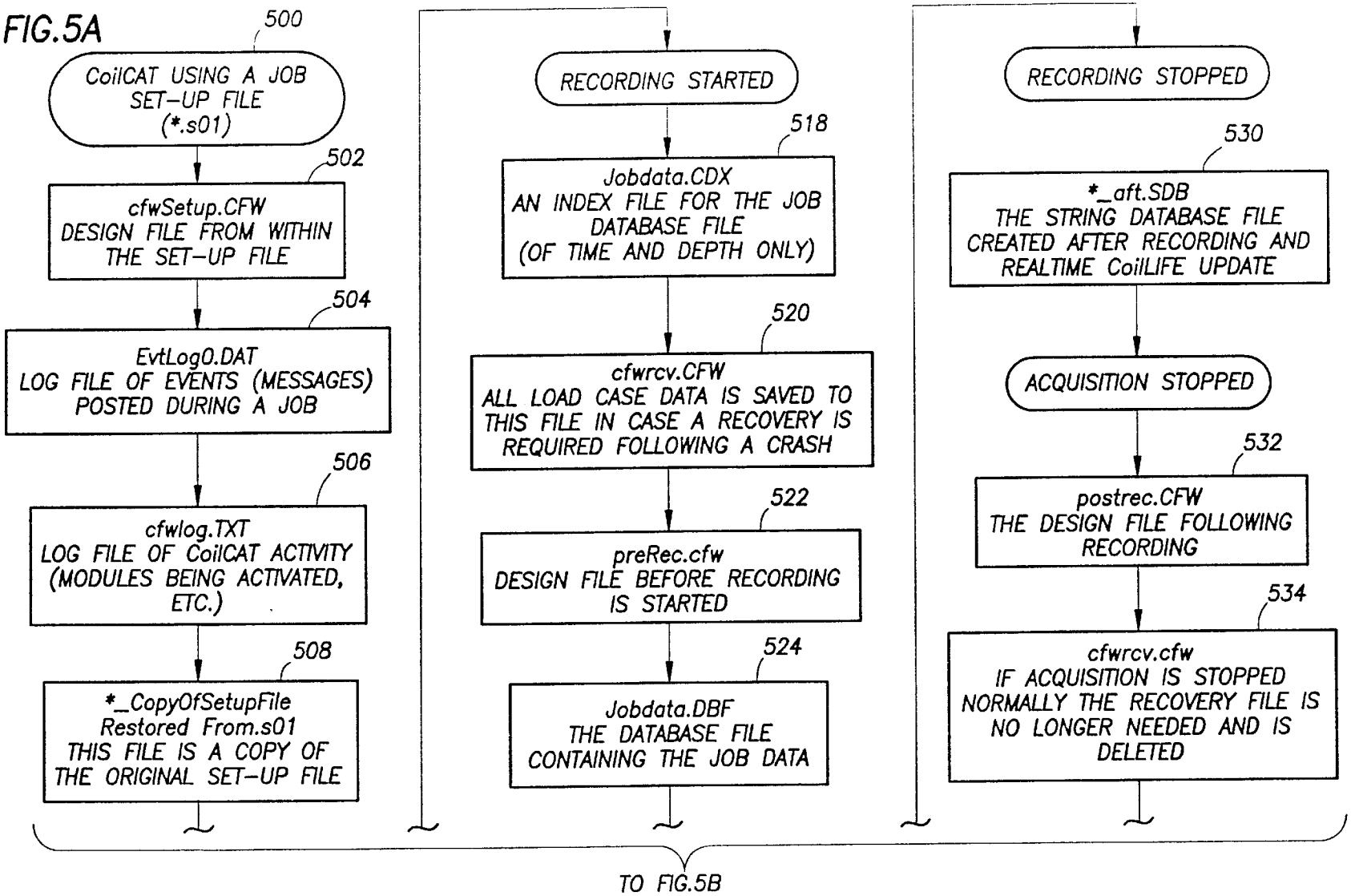
FIGS. 5A and 5B represent a flow chart of a software program for the collection and recording of data at a job site for coiled tubing during operation of the coiled tubing downhole.
Figure 5B:
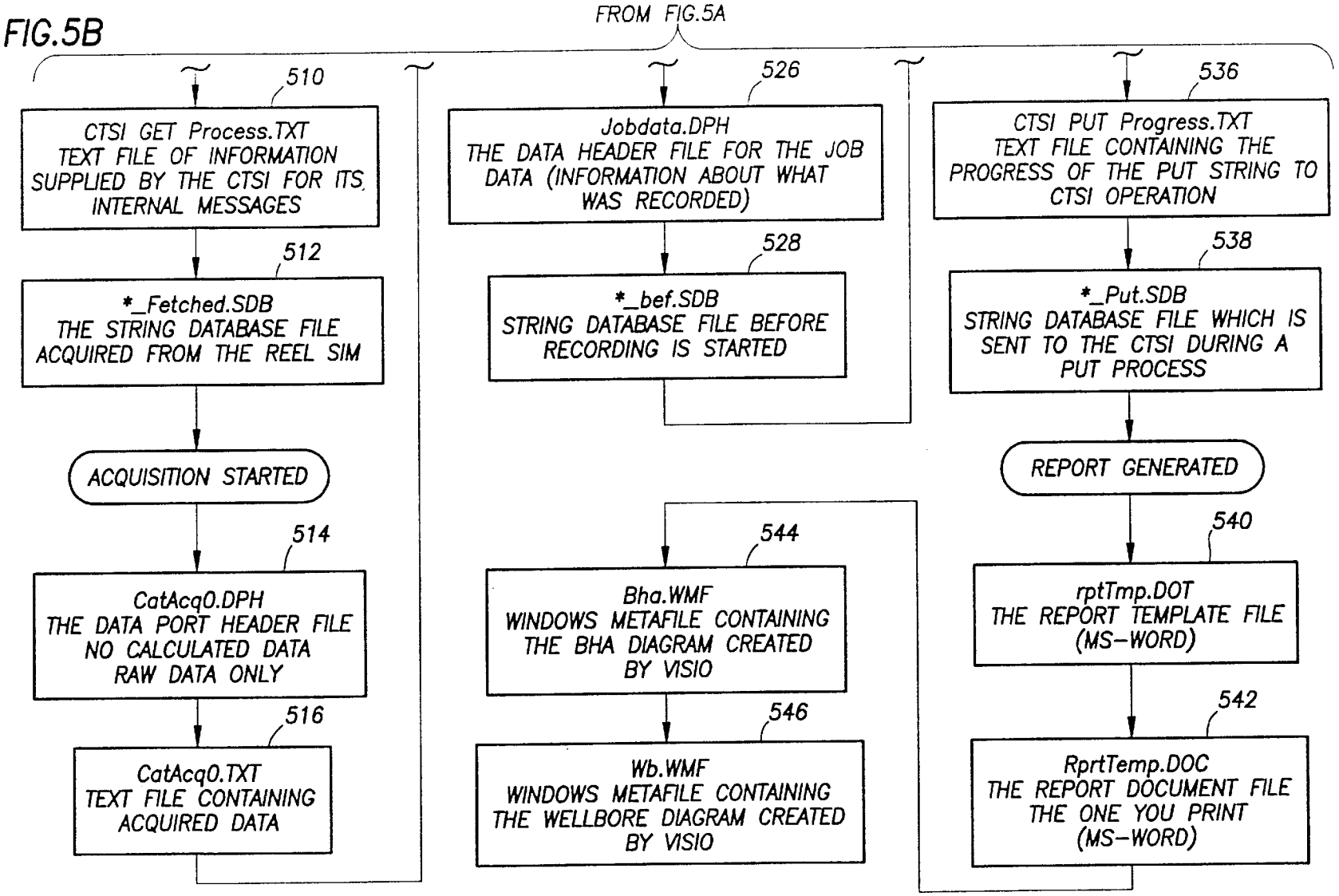

FIGS. 5A and 5B illustrate a program for COILCAT file management during operation. Each of the logic blocks describe a function accomplished by COILCAT software during data acquisition while coiled tubing operations are present. Logic blocks 500 to 512 describe software function for creating a set-up file and acquiring a database file for the REEL SIM 30A. After acquisition of data is started, logic blocks 514, 516 describe software functions for creating a text file of acquired data for each of the SIMs in the system. The logic blocks 518–528 describe software functions for creating a string database file before recording is started. The logic block 530 describes the software function of creating a string database file after recording and real time software data update has been accomplished. The logic blocks 532–558 describe software past acquisition functions for creating a string database file for sending to the CTSI 28. Logic blocks 540–546 describe software functions for report generation.

The computer program listing labeled D:\projects\ctsi\reel database process\CTSIDB.C comprises the computer program resident in the computer of CTSI 28 of FIG. 1.

The software for CTSI 28 runs on a commercial (non-realtime) multi-tasking multi-threaded operating system. The CTSI operating system after being powered on automatically initiates three processes. These processes include the "CTSI Main" process, the "Data Librarian" process, and the "Diagnostics" process.

The Data Librarian is the lowest priority task and has three functions. The first function is for watching over the CTSI file system and maintaining the file system size between the "high and low water marks". Thus, when the Data Librarian determines that the CTSI file system size is approaching the high water mark, it purges some of the oldest job data files until the file system size falls to the low water mark. Approximately 100 days of job data may be stored on the CTSI without deleting any old data files. The second function of the Data Librarian is to provide COILCAT access to data files in the CTSI. It uses a commercial "ftpd" (file transfer program daemon) to accomplish this. All of the functionality of Data Librarian is implemented using a high level scripting language. This does not require any "real" programming. The benefit of using a scripting language to accomplish this is that third party executables can be included in the Data Librarian without any modifications or recording.

The "Diagnostics" process is also a low priority process that executes in the background and monitors the data being acquired from the sensor bus. Its functions include watching over the data, the data rates, and power consumption, of the individual SIMS and the sensor bus. Writing sensor parameters and relevant data to different SIMS is also accomplished through this process. Using the COILCAT/CTSI remote process communication mechanism (TCP/IP sockets) presents the diagnostics information to the COILCAT system which displays it to the user upon request. Information screens integrated into the COILCAT HI are available to the user for this purpose.

The "CTSI Main" process, is a multi-threaded process that performs the actual data-acquisition from the SIM modules. The main routine upon initial execution creates the global data store and launches all of the threads (subprocesses). It then runs at idle priority and simply "watches" the execution of the different threads possibly terminating and restarting some if needed. The "CTSI Main" also communicates with COILCAT in order to allow COILCAT full control of the CTSI system. Among the different threads that are essential to the operation of the CTSI are the acquisition thread, the control thread, and the storage thread. The purpose of the acquisition thread is to communicate with the sensor bus interface driver and obtain data from the different SIM modules. The control thread is used for both the actual control of CTU sub systems and the modification of parameters on the SIMS such as sampling time, acquisition rate, transmit intervals etc. The purpose of the storage thread is to write the contents of the memory to disk at every acquisition interval. The depth and the weight threads implement the depth and weight functionality respectively.

The computer programs listed above are attached hereto as appendices 1 and 2.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

What is claimed is:

1. An assembly including, a structure on which coiled tubing is mounted, said coiled tubing arranged and designed for oil and gas well operations, and memory means disposed on said structure on which is recorded a database of predetermined operating characteristics of said coiled tubing.

2. The assembly of claim 1 further comprising:

means for determining operating characteristics of said coiled tubing during oil and gas well operations, and means for altering said database of said memory means by updating said predetermined operating characteristics of said coiled tubing with operating characteristics of said coiled tubing.

3. The assembly as set forth in claim 1 wherein:

said structure on which said coiled tubing is mounted comprises a reel mounted for rotation on a frame; and said memory means interfaces with a microprocessor secured to said frame for transport with said reel and coiled tubing thereon.

4. The assembly as set forth in claim 2 wherein said means for determining operating characteristics of said coiled tubing includes:

a main data processing unit, a cable extending from said main data processing unit, and sensing means for each of the operating characteristics of said coiled tubing connected to said cable to provide data to said main data processing unit, said data processing unit providing data to said database of said memory means.

5. The assembly as set forth in claim 4 wherein:

said means for altering said database of said memory means includes means for continuously sensing and recording data concerning said operating characteristics.

6. The assembly as set forth in claim 2 wherein:

said means for determining operating characteristics of said coil tubing includes a sensor interface module for each of the predetermined operating characteristics, a main data processing unit, and a cable connecting the sensor interface modules to said main data processing unit.

7. The assembly as set forth in claim 6 wherein:

each sensor interface module includes a sensor for a predetermined operating characteristic, said cable including a pair of wires for power and a pair of wires for transmitting and receiving data.

8. The assembly as set forth in claim 6 wherein:

said cable extends from and terminates at said main data processing unit to form a loop connecting said sensor interface modules.

9. A system for storing operating features of coiled tubing comprising:

a reel structure for said coiled tubing on which said coiled tubing is wound and a frame supporting said reel for rotation, said reel structure being transportable from one job site to another job site;

sensors for monitoring each of the predetermined features of the coiled tubing, each sensor being connected to a sensor module which includes a microprocessor;

a main computer means for receiving data from the sensors and processing said data in accordance with predetermined parameters for the coiled tubing features; and a reel database module permanently mounted on said reel structure prior to use of the coiled tubing at an initial job site; wherein:

said reel database module receives processed data from said main computer relating to said predetermined features of said coiled tubing and includes a microprocessor having memory for storage of said data, said reel database module being transportable with said reel structure from one job site to another job site.

10. A system as set forth in claim 9 wherein:

said sensors are provided for sensing predetermined features of said coiled tubing including tubing weight, length of tubing injected within the bore hole, and circulating fluid pressure.

11. Apparatus for determining selected characteristics of coiled tubing that is run in and out of a borehole for recording and storing such data for retrieval at a job site; said apparatus comprising:

a reel structure for said coiled tubing including a reel on which said coiled tubing is wound and a frame supporting the reel for rotation, said reel structure capable of being transported from one job site to another job site;

an injector structure for running the coiled tubing from the reel structure into said bore hole and for withdrawing said coiled tubing from the borehole;

sensor means for monitoring certain characteristics of said coiled tubing and including a sensor and a microprocessor for receiving and transmitting data relating to said characteristics of the coiled tubing;

a main computer means for receiving data from said sensor means and processing said data in accordance with predetermined parameters for said coiled tubing characteristics; and a reel database module mounted on said reel structure prior to use of the coiled tubing at an initial job site; said reel database module receiving processed data from said main computer relating to said predetermined coiled tubing characteristics and including a microprocessor having a memory for storage of said data;

said reel database module being transportable with said reel structure from one job site to another job site and being capable of transmitting stored data therein at said another job site when connected to a computer at said another job site for retrieval of such stored data.

12. Apparatus as set forth in claim 11 wherein:

means associated with said main computer is provided for recalculating said reel database module at the end of operation at a specific job site for storage in said reel database module for retrieval at a new job site.

13. A method for determining operating characteristics of coiled tubing during oil and gas operations while coiled tubing is run in and out of a borehole; said method comprising the steps of:

installing a reel structure on which said coiled tubing is mounted for unreeling and injection into the borehole;

installing a memory means on said reel structure on which is recorded and stored a database of predetermined operating characteristics of said coiled tubing;

sensing predetermined operating characteristics of said coiled tubing during oil and gas operations;

receiving and processing data from said sensing means; and transmitting said processed data to said memory means on said reel structure.

14. The method of claim 13 further comprising the step of:

updating the data supplied to said memory means on said reel structure at each job site where said coiled tubing is used for providing an accurate database of the entire history of each of the recorded operating characteristics.

15. The method of claim 14 further comprising the step of retrieving such data from said memory means at each job site.

* * * * *